US005876194A

United States Patent [19]

Suelter

[11] Patent Number: 5,876,194

[45] Date of Patent: Mar. 2, 1999

[54] FIXED-DISPLACEMENT VANE-TYPE HYDRAULIC MACHINE

[75] Inventor: Barry D. Suelter, Omaha, Nebr.

[73] Assignee: Vickers, Inc., Maumee, Ohio

[21] Appl. No.: 578,268

[22] Filed: Dec. 26, 1995

[51] Int. Cl.[6] ..... F01C 1/00; F03C 2/00

[52] U.S. Cl. ..... 418/259; 418/266

[58] Field of Search ..... 418/259, 260, 418/265, 266, 267, 268

[56] References Cited

U.S. PATENT DOCUMENTS

| | | | |
|---|---|---|---|
| 2,312,886 | 3/1943 | Ellinwood | 418/266 |
| 3,204,565 | 9/1965 | Kirkpatrick | 418/266 |
| 3,255,705 | 6/1966 | Eickmann | 418/267 |
| 3,479,962 | 11/1969 | Pettibone . | |
| 5,431,552 | 7/1995 | Schuller et al. . | |

*Primary Examiner*—Charles G. Freay
*Attorney, Agent, or Firm*—Barnes, Kisselle, Raisch, Choate, Whittemore & Hulbert, P.C.

[57] ABSTRACT

A fixed displacement vane-type hydraulic machine that includes a cartridge assembly having a rotor, a plurality of vanes carried by the rotor, side plates on opposed sides of the rotor, and a cam ring carried between the side plates surrounding the vanes and rotor to define fluid chambers between the vanes. A housing surrounds and encloses the cartridge assembly, and provides inlet and outlet passages for feeding fluid to and from the chambers. A shaft is coupled to the rotor and extends from the housing. A cam pin extends radially between the cam ring and the housing surrounding the cam ring for preventing rotation of the cam ring with respect to the housing so as to absorb reaction torque on the cam ring with respect to the housing due to pressure applied to the machine. In the preferred embodiment of the invention, the cam pin is affixed to the cam ring, and is slidably received within an axial pocket in the surrounding housing during assembly of the cartridge to the housing. The axial pocket may include either a portion of the fluid flow path that extends through the housing, or a pocket specially formed in the housing for receiving the cam pin.

9 Claims, 2 Drawing Sheets

FIXED-DISPLACEMENT VANE-TYPE HYDRAULIC MACHINE

The present invention is directed to fixed-displacement vane-type hydraulic machines (pumps and motors), and more particularly to an improved vane-type hydraulic machine and method of assembly that provides structure between the cam ring and surrounding housing for absorbing reaction torque on the housing.

BACKGROUND AND SUMMARY OF THE INVENTION

Vane pumps conventionally include a rotor coupled to an input shaft, a plurality of radial vanes carried by the rotor, side plates disposed on axially opposed sides of the rotor, and a cam ring carried between the side plates circumferentially surrounding the rotor. A plurality of fluid chambers are defined between the angularly spaced vanes, the axially spaced side plates and the radially spaced rotor and cam ring surfaces. A housing includes inlet and outlet passages for feeding hydraulic fluid to and from the chambers. Pressure applied to the pump creates a reaction torque on the cam ring, which must be absorbed by the surrounding housing. A similar reaction torque is created in vane-type hydraulic motors, in which flow of fluid through the housing and chambers provides a rotary output at the machine shaft.

It is a general object of the present invention to provide structure between the cam ring and the surrounding housing for absorbing the reaction torque caused by pressure applied to the pump. Another and more specific object of the present invention is to provide such torque-absorbing structure that is inexpensive, reliable, and can be readily implemented in vane-type machines of differing designs and constructions. Yet another object of the present invention is to provide torque-absorbing structure of the described character implemented in cartridge-type vane machines, which are currently preferred in the art, and/or which is adapted to be employed in machines for rotation in either direction. Yet another object of the invention is to provide a method of assembling machines of the described character.

A fixed displacement vane-type hydraulic machine in accordance with a presently preferred embodiment of the invention comprises a rotor, a plurality of vanes carried by the rotor, side plates on opposed sides of the rotor, and a cam ring carried between the side plates surrounding the vanes and rotor to define fluid chambers between the vanes. A housing surrounds and encloses the side plates and cam ring, and provides inlet and outlet passages for feeding fluid to and from the inter-vane chambers. A shaft is coupled to the rotor and extends from the housing. A cam pin (or key) extends radially between the cam ring and the housing surrounding the cam ring for preventing rotation of the cam ring with respect to the housing so as to absorb reaction torque on the cam ring with respect to the housing due to pressure applied to the pump. In the preferred embodiment of the invention, the cam pin is affixed to the cam ring, and is slidably received within an axial pocket in the surrounding housing during assembly of the cartridge to the housing. The axial pocket may comprise either a portion of the fluid flow path that extends through the housing, or a pocket specially formed in the housing for receiving the cam pin.

In the preferred embodiment of the invention, angularly spaced pins are affixed to and project radially from the cam ring. One of these pins is dimensioned for sliding fit with the surrounding housing during assembly. The other pin functions to locate the cam ring with respect to the housing, and thereby to prevent angular misalignment of the cam ring and the housing. The pins and slots do allow for reverse rotation of the pump mechanism within the housing.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
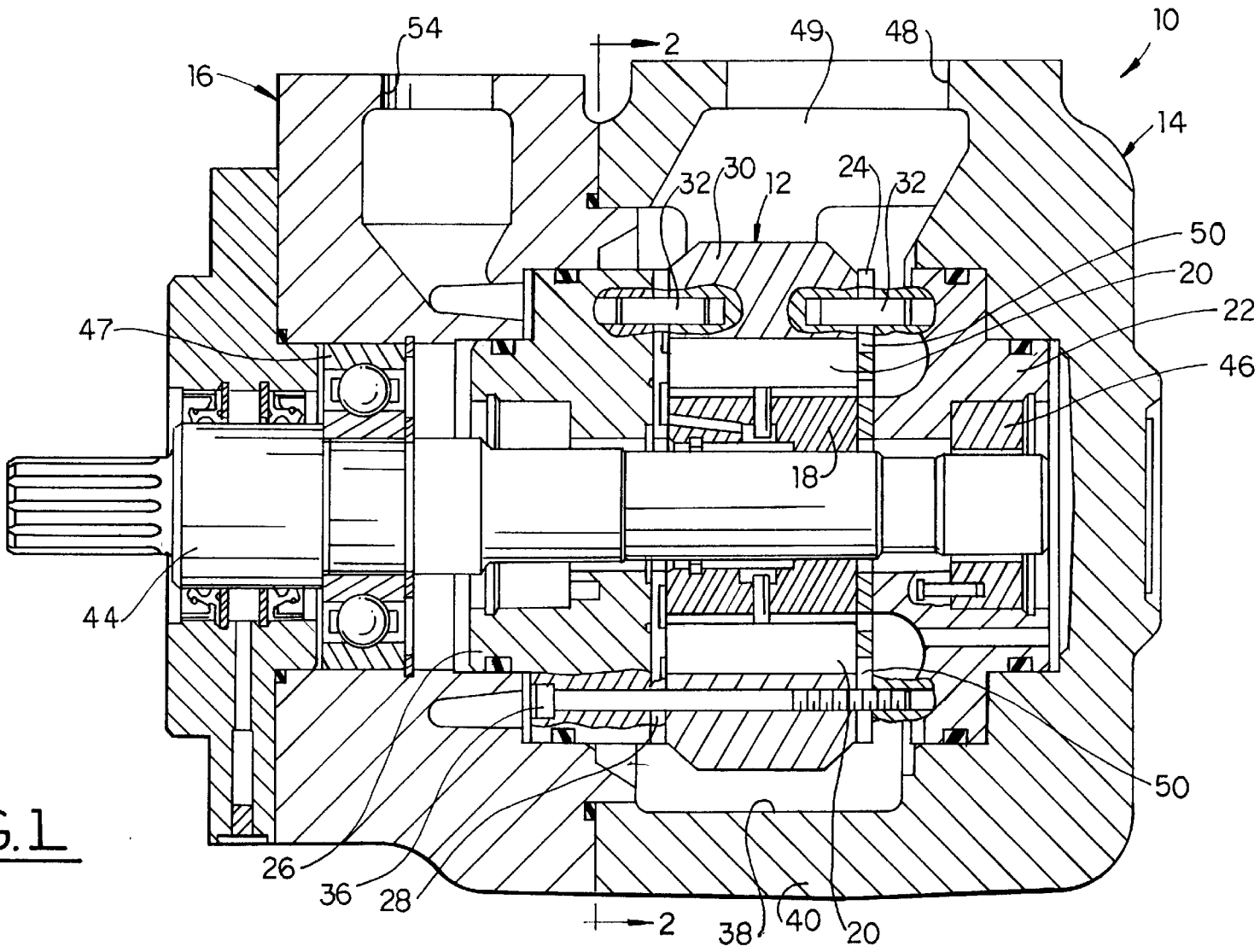
FIG. 1 is a sectional view that bisects a fixed displacement vane pump in accordance with a presently preferred embodiment of the invention.
Figure 2:
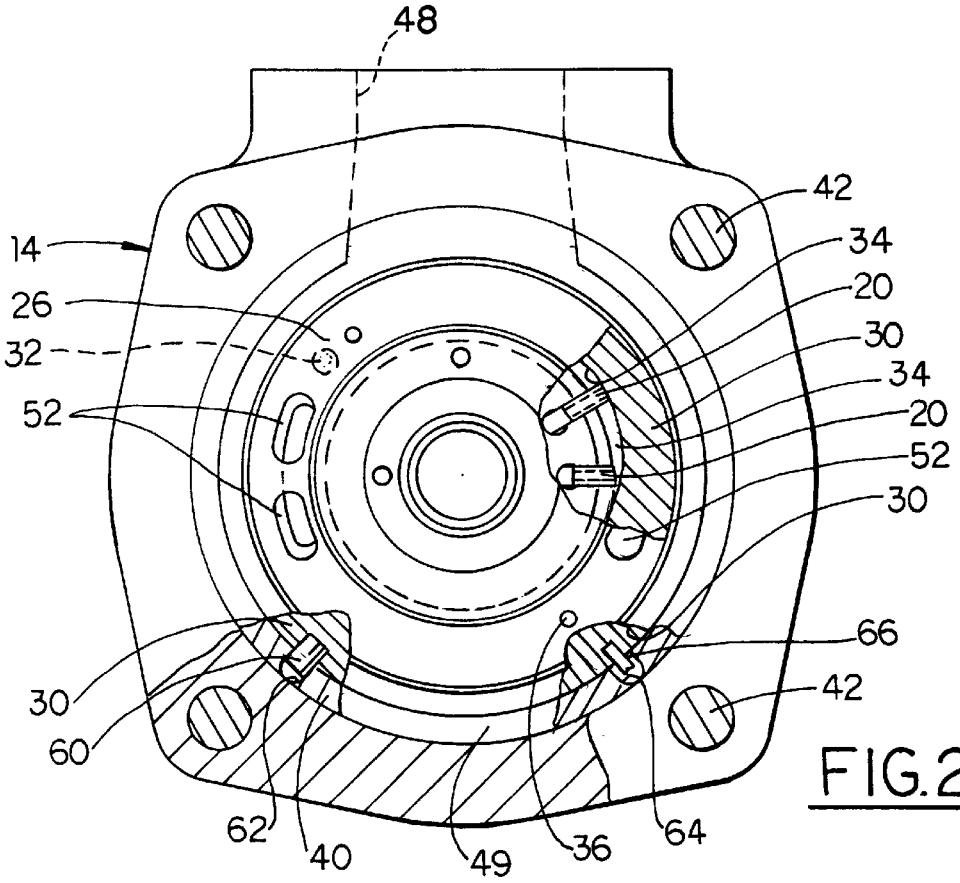
FIG. 2 is a fragmentary sectional view taken substantially along the line 2—2 in FIG. 1.

FIGS. 1 and 2 illustrate a fixed displacement vane pump 10 in accordance with a presently preferred embodiment of the invention as comprising a vane pump cartridge subassembly 12 mounted between an inlet end cover 14 and an outlet end cover 16. Cartridge 12 includes a rotor 18 having a plurality of radially oriented angularly spaced slots in which a corresponding plurality of vanes 20 are radially slidably disposed. An inlet side plate 22 and an inlet wafer or port plate 24 are disposed on one axial side of rotor 18, and an outlet side plate 26 and an outlet wafer or port plate 28 are disposed on the opposing axial side of rotor 18. A cam ring 30 is fixedly mounted by pins 32 between side plates 22, 26 radially and circumferentially surrounding rotor 18 and vanes 20. There are thus formed between angularly spaced vanes 20, between the axially spaced surfaces of wafer plates 24, 28, and between the radially spaced surfaces of rotor 18 and cam ring 30 a circumferential array of fluid pumping chambers 34 (FIG. 2). A plurality of angularly spaced screws 36 extend through side plates 22, 26, wafer plates 24, 28 and cam ring 30 for holding cartridge 12 as an assembly.

Inlet cover 14 has a central recess or pocket 38 formed by an axially extending flange 40 that surrounds cartridge 12 in assembly. Outlet cover 16 is fastened to inlet cover 14 by a plurality of screws 42 (FIG. 2). O-ring seals are carried by cartridge 12 and covers 14, 16 for sealingly joining the covers to each other and to cartridge 12 where appropriate. A shaft 44 is rotatably carried by bearings 46, 47 in side plate 22 and cover 16 respectively, and is coupled to rotor 18 of cartridge 12 for providing input drive to the pump mechanism. Inlet cover 14 has a radially opening inlet port 48. Port 48 opens to an inlet chamber 49 that surrounds cartridge 12, and is connected by ports 50 in side plate 22 and wafer plate 24 both to pumping chambers 34 surrounding rotor 18 and to the under-vane chambers in rotor 18 for urging the vanes radially outwardly against the opposing surface of cam ring 30. Pumping chambers 34 are also connected through ports 52 (FIG. 2) in wafer plate 28 and side plate 26 to an outlet port 54 that opens radially from outlet cover 16.

To the extent thus far described, pump 10 is of generally conventional construction. Rotation of shaft 44 by an external source of pumping energy rotates rotor 18 and reciprocates vanes 20 with respect to cam ring 30. The positive displacement pumping action in the inter-vane chambers pulls fluid through inlet port 48 and inlet cavity 49 surrounding cartridge 12, and pumps the fluid through the cartridge outlet ports and pump outlet port 54. Pressure applied to the pump creates a reaction torque on cartridge 12, which must be absorbed by the surrounding housing formed by covers 14, 16.

In accordance with the present invention, a pin 60 (FIG. 2) is affixed to and extends radially outwardly from cam ring 30 of cartridge 12 into close engagement with an opposing pocket 62 formed in flange 40 of inlet cover 14. Pin 60 is preferably of solid cylindrical construction, and cooperates with slot 62 in cover 14 for absorbing the reaction torque generated by the pumping cartridge. The axis of pin 60 is radial to the axis of shaft 44. Pocket 62 preferably comprises an axial slot in flange 40 that is either cast into the cover flange, or is machined into the flange following the forming operation. A secondary slot 64 preferably is machined or otherwise formed on the opposite side of housing cover 14 for allowing pumping cartridge 12 to be assembled to the housing in opposite orientation—i.e., for pumping rotation in either direction. Slot 64, which is angularly spaced from slot 62, receives in assembly a pin 66, which is mounted to and projects radially from cam ring 30, and which may be of smaller dimension than cam pin 60. Pin 66 ensures that pumping cartridge 12 will be assembled to end cover 14 at proper angular orientation.

In assembly, pin 60 is press fitted into cam ring 30, or secured by adhesive within its cam ring opening. Pin 66, which may be a spring roll pin, is press fitted into ring 30. After cartridge 12 is assembled, the cartridge is axially fitted into pocket 38 by axial movement of pins 60, 66 into their associated pockets 62, 64. Pin 60 has a close sliding fit into pocket 62, but pin 66 may be much smaller than pocket 64 since the only function of pin 66 is to prevent misalignment during assembly. Thus pins 60, 66 together serve to time the cartridge input and output ports with respect to the pump housing, while pin 60 alone absorbs reaction forces on the cam ring.

By locating torque pin 60 on cam ring 30, and thus at the point of largest outside diameter of pumping cartridge 12, the force on pin 60 due to the reaction forces between the pumping cartridge and the surrounding housing is reduced to a minimum. This reaction torque is taken directly from the cam ring to the housing, as opposed to absorbing the torque through other intermediate components. As loading is increased, the cam ring expands so as to be completely radially supported by the surrounding housing structure, so that forces applied to the pin are pure shear forces without any bending forces or moments. These shear forces are in a plane perpendicular to the axis of the pin.

Figure 3:
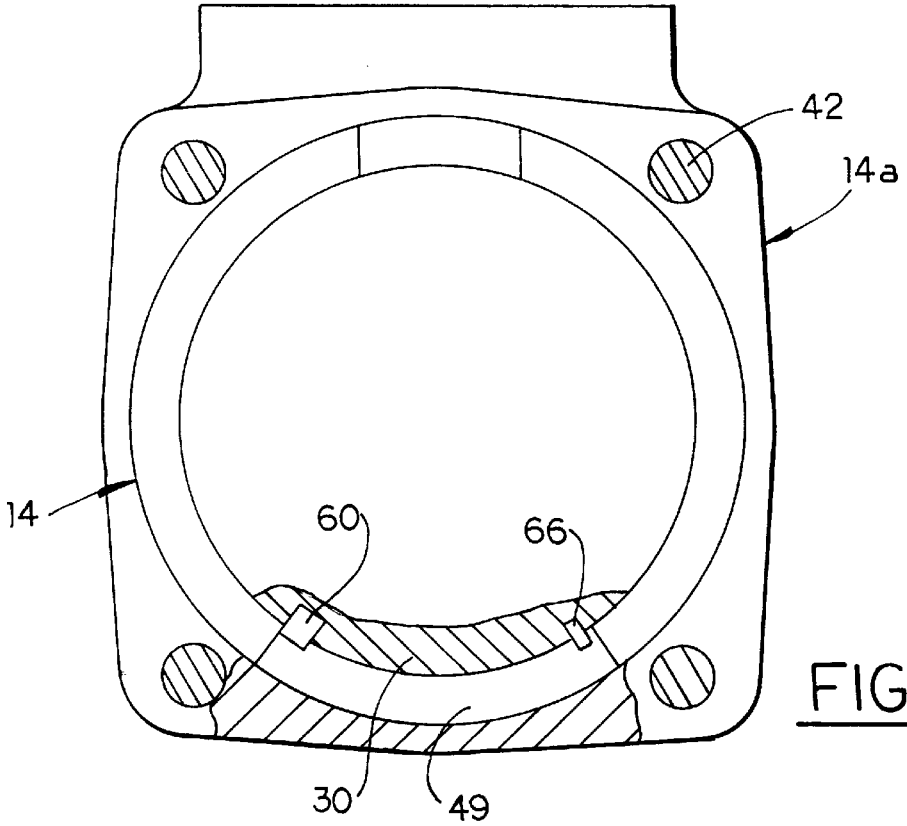
FIG. 3 is a fragmentary sectional view similar to that of FIG. 2 but showing a modified embodiment of the invention.

FIG. 3 illustrates a modified embodiment of the invention in which, instead of individual slots 62, 64 in FIG. 2, torque pin 60 and orientation pin 66 are disposed at angularly spaced edges of inlet flow flow chamber 49 in inlet cover 14*a*. Reaction torque on the pumping cartridge is still absorbed by cover 14 of the pump housing, as in the embodiment of FIGS. 1 and 2, since such torque is unidirectional. That is, torque pin 60 need only abut end cover 14 from one angular direction, corresponding to the direction of rotation of the pumping mechanism within the housing.

Although the invention has been described in connection with two presently preferred embodiments thereof, modifications and variations are envisioned. For example, the invention is by no means limited to cartridge-type pumps, but can be employed in connection with all types of vane pumps. Pin 60 need not be cylindrical, but may have a flat machined in it or be replaced by a key of square cross section.

I claim:

1. A fixed displacement vane-type hydraulic machine that comprises:

a vane-type fluid mechanism including a rotor, a plurality of vanes carried by said rotor, side plates on opposed sides of said rotor, and a cam ring carried between said side plates surrounding said vanes and rotor to define fluid chambers between said vanes, housing means surrounding and enclosing said mechanism, including inlet and outlet passage means for feeding fluid to and from said chambers, a shaft coupled to said rotor and extending from said housing means, and torque means extending radially between said mechanism and said housing means and preventing rotation of said mechanism with respect to said housing means so as to absorb reaction torque on said mechanism with respect to said housing means due to pressure applied to said machine, said torque means being affixed to said cam ring and extending into an opposing radial pocket in said housing means, said pocket extending axially through said housing means to facilitate assembly of said cam ring and mechanism to said housing means, said pocket being formed by one of said inlet and outlet passage means.

2. The machine set forth in claim 1 wherein said mechanism comprises a cartridge assembly; wherein said housing means includes inlet and outlet covers, and means mounting said inlet and outlet covers to each other to enclose said cartridge; and wherein said pocket comprises a slot extending axially into one of said covers.

3. A fixed displacement vane-type hydraulic machine that comprises:

a vane-type fluid mechanism including a rotor, a plurality of vanes carried by said rotor, side plates on opposed sides of said rotor, and a cam ring carried between said side plates surrounding said vanes and rotor to define fluid chambers between said vanes, housing means surrounding and enclosing said mechanism, including inlet and outlet passage means for feeding fluid to and from said chambers, a shaft coupled to said rotor and extending from said housing means, and torque means extending radially between said mechanism and said housing means and preventing rotation of said mechanism with respect to said housing means so as to absorb reaction torque on said mechanism with respect to said housing means due to pressure applied to said machine, said torque means being affixed to said cam ring and extending into an opposing radial pocket in said housing means, said housing including a pair of said radial pockets angularly spaced from each other such that said housing means is adapted to receive cartridges for rotation in either direction.

4. The machine set forth in claim 3 wherein there are a pair of means mounted on said cam ring for receipt in said pockets.

5. The machine set forth in claim 4 wherein one of said pair of means comprises locating means preventing misorientation of said mechanism in said housing means while the other of said pair of means comprises said torque means.

6. A method of constructing a vane-type hydraulic machine that comprises the steps of:

(a) forming a fluid mechanism that includes a rotor, a plurality of vanes slidably carried by said rotor, side plates or opposed sides of said rotor, a cam ring radially surrounding said rotor, and torque means projecting radially outwardly from said cam ring, (b) forming a pair of end covers, one of which has a recess for receiving said mechanism, a flange surrounding said recess, and an axially extending pocket in said flange, (c) assembling said mechanism to said one cover by sliding said torque means into said pocket while positioning said mechanism in said recess, and (d) assembling said end covers to each other so as to capture said mechanism within said end covers.

7. The method set forth in claim 6 wherein said pocket is machined in said flange.

8. The method set forth in claim 6 wherein said pocket is cast into said flange.

9. The method set forth in claim 6 wherein said step (b) includes the step of forming a pair of said pockets angularly spaced from each other in said flange, wherein said step (a) comprises the step of providing said torque means in the form of a pair of pins projecting radially outwardly from said cam ring and angularly spaced from each other, and wherein said step (c) comprises the step of positioning said pins in respective ones of said pockets, one of said pins serving to orient said cartridge with respect to said one end cover and the other functioning in operation of said machine to absorb reaction torque on said cam ring.

* * * * *